US006475969B2

(12) United States Patent
Scepanski

(10) Patent No.: US 6,475,969 B2
(45) Date of Patent: Nov. 5, 2002

(54) SOLID CAST CHLORINATED COMPOSITION

(75) Inventor: William H. Scepanski, Bloomington, MN (US)

(73) Assignee: Sunburst Chemicals, Inc., Bloomington, MN (US)

( * ) Notice: Subject to any disclaimer, the term of this patent is extended or adjusted under 35 U.S.C. 154(b) by 67 days.

(21) Appl. No.: 09/809,875

(22) Filed: Mar. 16, 2001

(65) Prior Publication Data

US 2002/0002129 A1 Jan. 3, 2002

Related U.S. Application Data

(60) Provisional application No. 60/189,791, filed on Mar. 16, 2000.

(51) Int. Cl.[7] ..... C11D 3/395; C11D 9/42; C11D 17/06

(52) U.S. Cl. ..... 510/294; 510/298; 510/302; 510/355; 510/445; 510/446; 252/187.34

(58) Field of Search ..... 510/294, 298, 510/302, 355, 445, 446; 252/187.34

(56) References Cited

U.S. PATENT DOCUMENTS

| | | | | |
|---|---|---|---|---|
| 3,429,821 | A | | 2/1969 | Weinstein et al. |
| 3,759,834 | A | | 9/1973 | Parke et al. |
| 3,908,045 | A | | 9/1975 | Alterman et al. |
| 3,956,160 | A | | 5/1976 | Watanabe et al. |
| 3,983,252 | A | | 9/1976 | Buchalter |
| 3,983,254 | A | | 9/1976 | Alterman et al. |
| 4,206,069 | A | | 6/1980 | Borrello |
| 4,292,191 | A | | 9/1981 | Gray |
| 4,412,934 | A | | 11/1983 | Chung et al. |
| 4,430,236 | A | | 2/1984 | Franks |
| 4,512,908 | A | | 4/1985 | Heile |
| 4,595,520 | A | | 6/1986 | Heile et al. |
| 4,655,780 | A | | 4/1987 | Chun et al. |
| 4,657,784 | A | | 4/1987 | Olson |
| 4,680,134 | A | | 7/1987 | Heile et al. |
| 4,681,696 | A | | 7/1987 | Bruegge et al. |
| 4,681,914 | A | | 7/1987 | Olson et al. |
| 4,707,160 | A | | 11/1987 | Chun et al. |
| 4,731,195 | A | | 3/1988 | Olson |
| 4,769,159 | A | | 9/1988 | Copeland |
| RE32,763 | E | | 10/1988 | Fernholtz et al. |
| RE32,818 | E | | 1/1989 | Fernholz et al. |
| 4,828,745 | A | | 5/1989 | Jeschke et al. |
| 4,832,864 | A | | 5/1989 | Olson |
| 4,846,989 | A | | 7/1989 | Killa |
| 4,861,518 | A | | 8/1989 | Morganson et al. |
| 4,863,632 | A | | 9/1989 | Aronson et al. |
| 4,911,860 | A | | 3/1990 | Van Den Brom |
| 4,913,832 | A | | 4/1990 | Kruse et al. |
| 4,933,102 | A | | 6/1990 | Olson |
| 5,080,819 | A | | 1/1992 | Morganson et al. |
| 5,133,892 | A | | 7/1992 | Chun et al. |
| 5,202,047 | A | | 4/1993 | Corby |
| 5,213,705 | A | | 5/1993 | Olson |
| 5,225,102 | A | | 7/1993 | Coyne et al. |
| 5,340,501 | A | | 8/1994 | Steindoft |
| 5,342,587 | A | | 8/1994 | Laughlin et al. |
| 5,358,653 | A | | 10/1994 | Gladfelter et al. |
| 5,397,506 | A | | 3/1995 | Groth et al. |
| 5,407,598 | A | | 4/1995 | Olson et al. |
| 5,665,694 | A | | 9/1997 | Backes et al. |
| 5,670,473 | A | * | 9/1997 | Scepanski ..... 510/445 |
| 5,759,988 | A | * | 6/1998 | Heile et al. ..... 510/441 |
| 5,876,514 | A | * | 3/1999 | Rolando et al. ..... 134/25.2 |
| 5,929,011 | A | | 7/1999 | Scepanski |
| 5,977,183 | A | * | 11/1999 | Scepanski ..... 514/643 |
| 6,028,113 | A | * | 2/2000 | Scepanski ..... 514/643 |

* cited by examiner

*Primary Examiner*—Yogendra N. Gupta
*Assistant Examiner*—John M Petruncio
(74) *Attorney, Agent, or Firm*—Patterson, Thuente, Skaar & Christensen, P.A.

(57) ABSTRACT

A solid cast detergent product containing an active chlorine source is disclosed. Methods of manufacture and of use are also disclosed for the solid cast detergent product containing an active chlorine source.

44 Claims, 1 Drawing Sheet

SOLID CAST CHLORINATED COMPOSITION

CROSS-REFERENCE TO RELATED APPLICATIONS

This application claims priority under 35 U.S.C. § 119 (e) to, and hereby incorporates by reference, U.S. Provisional Application Nos. 60/189,791, filed Mar. 16, 2000.

BACKGROUND OF THE INVENTION

1. Field of the Invention

This invention relates to a solid cast composition containing an active chlorine source suspended in a substantially waxy carrier.

2. Background

Detergent products formulated with high levels of an active chlorine source, such as a chlorinated isocyanurate, tend to liberate chlorine gas in response to a variety of conditions. Chlorine gas is highly toxic and can be reactive to the point of causing spontaneous ignition. Heat, acidity, and moisture are conditions especially tending to promote chlorine gas liberation in these products. For example, heat normally causes the active chlorine source to liberate chlorine gas. Thus, manufacturing and storage conditions dictate constraints on the use of active chlorine sources such as those above. Active chlorine sources are typically affected by low pH conditions favoring chlorine gas liberation. Hence, the presence of acidic materials in proximity to active chlorine sources must be considered in manufacturing an active chlorine-containing composition.

Yet another factor which must be considered in manufacturing a detergent product containing an active chlorine source is water, which also promotes chlorine gas liberation from these compounds. In detergent products containing a strong base such as sodium or potassium hydroxide and an active chlorine source, an exothermic reaction between the active chlorine source and the base may form water. The water, in turn, promotes liberation of chlorine gas from the remaining active chlorine source. Moreover, heat generated from these exothermic reactions further promotes chlorine gas liberation from the active chlorine source. The water, formed from the reaction from the strong base and a proton donating substance, further promotes dispersion of the strong base and the other ingredient reacting with the strong base. The dispersed strong base then reacts with more of the active chlorine source to liberate still more chlorine gas. These effects, therefore, promote or accelerate the reaction to completion by releasing further quantities of heat and water as the reaction proceeds. Moreover, if the source of alkalinity (the strong base) is sufficiently depleted, the liberated chlorine gas may combine with water to form an acid, thereby further reducing the pH in the vicinity of the active chlorine source. This, in turn, still further promotes the liberation of chlorine gas from the active chlorine source. Hence, manufacturing substantially solid cast chlorinated cleaning compositions requires combining carefully selected ingredients under strictly controlled manufacturing conditions.

Normally, one skilled in the art would avoid using ingredients which liberate chlorine gas when combined in a single product. One alternative to avoiding ingredient combinations favoring chlorine liberation from an active chlorine source is to stabilize the conflicting ingredients before or during the manufacturing process.

U.S. Pat. No. 3,908,045, issued to Alterman et al., Sep. 23, 1975, discloses particles of a fluidizable substance coated with a non-aqueous solution. Disclosures similar to U.S. Pat. No. 3,908,045 are found in U.S. Pat. No. 3,983,254, issued to Alterman et al., Sep. 28, 1976.

U.S. Pat. No. 4,655,780, issued to Chun et al., Apr. 7, 1987, discloses hard spherical bleaching particles utilizing an active halogen oxidizing material. U.S. Pat. No. 4,657,784, issued to Olson et al., Apr. 14, 1987, discusses the use of encapsulated halogen bleaches. U.S. Pat. No. 4,731,195, issued Mar. 15, 1988 to Olson et al. (a divisional application of U.S. Pat. No. 4,657,784), contains similar disclosures.

The use of an active halogen bleach encapsulated with a synthetic detergent such as sodium octyl sulfonate is disclosed in U.S. Pat. No. 4,681,914, issued Jul. 21, 1987 and in U.S. Pat. No. 5,407,598 issued Apr. 18, 1995, both to Olson et al.

U.S. Pat. No. 5,213,705, issued May 25, 1993 to Olson, also discloses an active halogen bleach encapsulated with a synthetic detergent. Chun et al., in U.S. Pat. No. 4,707,160, issued Nov. 17, 1987, discloses particles with a core containing a halogen bleach. U.S. Pat. No. 5,133,892, issued Jul. 28, 1992 to Chun et al., discloses a multi layer detergent tablet.

Aronson et al., in U.S. Pat. No. 4,863,632 issued Sep. 5, 1989, disclose a bleaching particle having an oxidizing material surrounded by a polycarbonate coating. U.S. Pat. No. 5,358,653, issued to Gladfelter et al., Oct. 25, 1994, discloses a cleaning product containing a chlorine source.

U.S. Pat. No. 5,929,011, issued to Scepanski, Jul. 27, 1999 and assigned to the assignee of the present invention, discloses a solid cast detergent product containing an active chlorine source suspended in a free fatty acid.

Other than as 100% free fatty acids, none of the foregoing references, however, discloses using the waxy ingredients or combination of waxy ingredients of this invention in a substantially solid cast composition as utilized in the present invention to prepare a stable detergent composition with an active chlorine source. This method of manufacture advantageously results in a stable solid cast composition with ingredients previously considered to be incompatible with an active chlorine source. Moreover, the waxy ingredients disclosed herein enable solid cast compositions to be made with more widely available dispensing choices than using 100% fatty acids. Moreover, when a combination of waxy substances without free fatty acids is used with hard water (with divalent cations) the end result is clean garments free from the dinginess of precipitated free fatty acid-divalent salts. Furthermore, the waxy substances of the present invention still impart a softness to laundered articles to reduce or eliminate the harsh feel. In contrast to free fatty acids, this softening property is present even when using hard water.

Surprisingly, by practicing the present invention as described herein, the challenge of manufacturing such a highly desirable product becomes manageable. Specifically, the present invention provides important advantages, including: (1) minimizing or eliminating chlorine liberation; (2) preventing the detergent builder (if present) from acting hygroscopically; and (3) promoting dispersion of the ingredients by inclusion of the detergent builder (if present).

To the extent that the foregoing references are applicable to the present intention, they are herein incorporated by reference. Temperatures specified herein are in degrees F., unless other wise indicated. throughout the specification and claims, percentages and ratios are by weight, unless otherwise indicated. Percentages are based upon the combined weight of the component recited in the pertinent claims. Ranges and ratios specified herein may be combined.

DETAILED DESCRIPTION OF THE INVENTION

Figure 1:
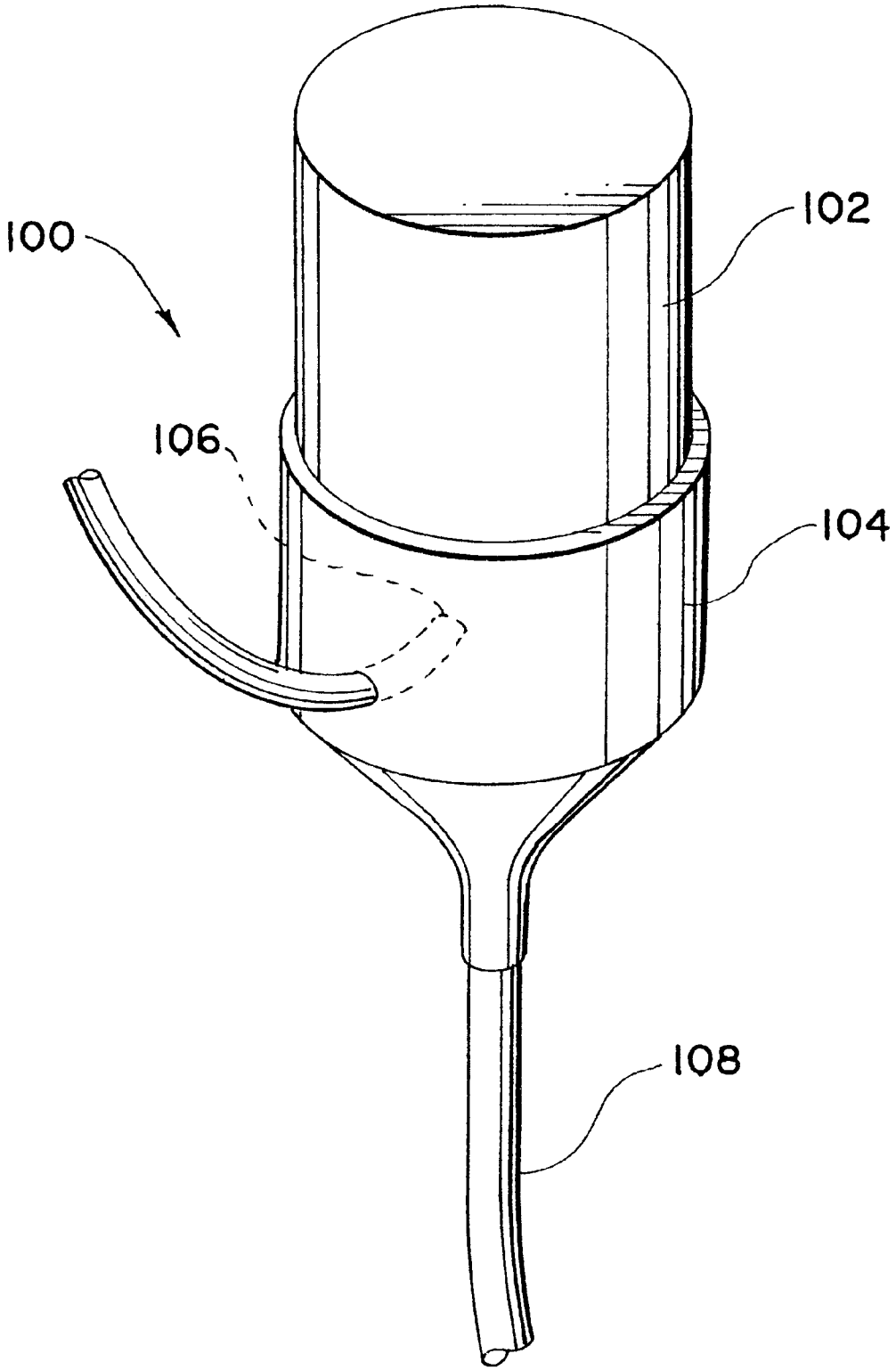
FIG. 1 is a schematic representation of a dispenser with a container (filled with the present solid cast detergent composition), the dispenser with a tip for directing water into the open end of the container.

For purposes of explaining the present invention, the term "solid cast" or "substantially solid cast" is defined as an essentially homogeneous dispersion which will not exit a container through a narrowed opening when the container is inverted. The substantially solid cast of this invention is substantially homogeneous in that ingredients are either dissolved or dispersed evenly when the substantially solid cast is being formed. A molten composition according to the present invention is conveniently placed in a container, wherein the molten composition cools and solidifies or hardens into a substantially solid cast. In one embodiment, the present substantially solid cast is solidified by being cooled below its melting point, rather than by being hydrated. The substantially solid cast composition of this invention is differentiated from compositions which, while solid, are powdered, particulate, or granular. In contrast to powders, particulates, or granules, the present solid cast will not exit an inverted opened container as opposed to products which are considered free flowing and are not present as a single discreet mass.

In some embodiments, the substantially solid cast products of this invention are those wherein the product will not pass through a 1.27 square centimeter sieve. Stated otherwise, the solid cast products of this invention have dimensions, whether spherical, cylindrical, rectangular, elliptical, or the like, or irregular in nature, which are greater than 1.27 cm, greater than 2.0 cm, or greater than 4 cm. The size of the solid cast product is further important in that the surface area accessible to water migration is small as compared to powdered, particulate, and granular products. By contrast, powdered, particulate, or granular products present a relatively large surface area which is accessible to water migration from the atmosphere, potentially resulting in loss of chlorine from the active chlorine source. Percentages or proportions of ingredients disclosed herein are by weight unless stated otherwise.

Components

Active chlorine sources are defined as containing compounds which produce chlorine compounds or elemental chlorine, the chlorine compounds or elemental chlorine being oxidizing agents when used in a washing or disinfecting solution. Active chlorine sources are known in the art as any of several substances conventionally utilized in laundry and hard surface cleaning applications. Representative active chlorine sources include, but are not limited to, substances containing sodium and potassium dichloro(iso) cyanurate, chlorinated trisodium phosphate, calcium, lithium, sodium, or potassium hypochlorite, trichlormelamine chloramines T, as well as other organic chlorine sources containing a nitrogen atom in their structures. Active chlorine sources which are alkali metal-cation free may also be utilized. One such cation free source is trichloro(iso) cyanuric acid. Moreover any mixture of the foregoing may be utilized as well. Dry (or non-liquid) formulations of active chlorine sources, such as powders or granules, may be used. The active chlorine source may be present in the present substantially solid cast composition in amounts between about 1% and 90%, between about 5% and 60%, and between about 10% and 40%. The active chlorine source may contain between about 50% and 70%, between about 0.2% and 60%, between about 1% and 50%, between about 2%–40%, about 60%, or about 55% available chlorine, or any range subsumed therein.

The waxy substances in which the active chlorine source is suspended are characterized by a melting point between about 80° F. and 180° F., between about 100° F. and 160° F., between about 100° F. and 140° F., or any range subsumed therein. Free fatty acids, when used alone, are expressly defined as being excluded from the waxy substances of this invention. The present waxy substances are contemplated to be present in the substantially solid cast composition of this invention in amounts between about 10% and 99%, between about 15% and 70%, between about 25% and 50%, or any range subsumed therein, of the total mass thereof. Non-limiting examples of these waxy substances include fatty alcohols (e.g., $C_{12}$ –$C_{24}$ linear and alkylphenol) and paraffins.

While free fatty acids are not contemplated to be used alone, they may also be included as components in mixtures with the above-disclosed waxy compounds. Thus, any combination of the above-disclosed compounds is contemplated to be within the scope of this invention.

In one embodiment, the paraffins used are greater than about $C_{25}$. In yet another embodiment, the paraffins are utilized in mixtures with one or more other waxy substances. With the exception of paraffins, the waxy substance molecule may include an alcohol group (e.g., primary, secondary, or tertiary).

Additional substances which may be added to the solid cast of this invention include detergent builders, water conditioning agents, surfactants, and solubility modifying agents.

Detergent builders (acid, neutral, and alkaline builders) may be added to the composition and are usually suspended in the solid detergent during the manufacturing process. Alkaline builders are water-soluble bases added to the detergent compositions to raise the pH of the cleaning solution. The amount of alkaline builder used will depend on the relative amounts and identities of the other components present, as well as the desired pH of the use solution needed to achieve the desired cleaning effect. Powdered, beaded, liquid, or granular alkaline builders can be used when manufacturing the present invention. Generally, any water-soluble base may be used, although certain bases are commonly used as alkaline builders in the industry. Suitable alkaline builders include alkali metal silicates such as sodium or potassium silicate, alkali metal carbonates such as sodium or potassium carbonate, alkali metal phosphates such as trisodium or tripotassium phosphate, alkali metal borates such as sodium or potassium borate, alkali metal dibasic phosphates such as $Na_2HPO_4$, $K_2HPO_4$, alkali metal hydroxides such as sodium or potassium hydroxide, and alkyl alcohol amines such as monoethanolamine, diethanolamine, and triethanolamine. Detergent builders may be present in the present substantially solid cast composition in amounts between about 1% and 40%, between about 1% and 20%, between about 2% and 10%, or in any range subsumed therein.

Chelating, sequestering, or scale-inhibiting ingredients may be added to the present invention to neutralize adverse consequences of having divalent and trivalent ions of calcium, magnesium, iron, and other less significant polyvalent metal cations present in the washing solution. These divalent and trivalent cations may enter the cleaning water as dissolved cations present in the water source or with the soils that are to be removed by cleaning, e.g., laundry as well as hard surfaces. These divalent and trivalent ions reduce the effectiveness of the detergents, which may be added to the present invention. Subsequent reference to "hardness ions" refers to calcium, magnesium, and, to a lesser degree, iron and other multivalent cations found in "hard water."

When an anionic surfactant is used, hardness ions can combine with the anionic surfactant to not only reduce the ability of the anionic surfactant to solubilize unwanted materials, but may also precipitate the surfactant anion itself. If the surfactant anion is precipitated, the precipitate adds to the soil to be removed rather than removing it. Precipitated surfactant also causes greasy films on hard surfaces or gray and yellow tints on fabrics rather than the cleaning and whitening desired. Hardness ions may also precipitate fatty acids present in soils, thereby preventing their solubilization and subsequent removal by surfactants. Inorganic anions, such as carbonates, phosphates, silicates, sulfates, and hydroxides can precipitate with hardness ions to form inorganic films, spots, or deposits or to gray or otherwise discolor fabrics. Hence, the term "sequestering" is used to generally include chelating and sequestering multivalent metal ions to inhibit formation of insoluble hardness salts. Sequestering or scale inhibiting compounds will prevent these adverse effects because they bind hardness ions. The bound and/or sequestered ions are kept in solution and thereby prevented from forming precipitates with the above-described organic and inorganic anions.

Hardness metal sequestering agents may be present in the present invention in amounts between about 1% and 40%, between about 2% and 30%, between about 5% and 20% or any range subsumed therein. Sequestering agents suitable for use in the present invention include, but are not limited to, the following compounds:

1. Sodium, potassium, and ammonium salts of orthophosphate or polyphosphates such as pyrophosphate, tripolyphosphate, trimetaphosphate, hexametaphosphate, or other higher complex phosphates with up to about 22 phosphorus atoms in the anion.
2. Ethylenediaminetetraacetic acid or its fully or partially neutralized salts, e.g., sodium, potassium, ammonium or mono-, di- or triethanolamine salts.
3. Nitrilotriacetic acid or its full or partially neutralized salts, e.g., sodium, potassium, ammonium or mono, di or triethanolamine salts.
4. Other aminocarboxylic acids and their salts, for example:
   pentasodium diethylenetriaminepentaacetate;
   trisodium hydroxyethylethylenediaminetriacetate; disodium
   ethanoldiglycine, and sodium diethanolglycine.
5. Organic polycarboxylic acids and their salts, such as, oxalic acid, citric acid and gluconic acid.
6. Polyacrylic acid polymers and the sodium, potassium, ammonium or mono-, di-, or triethanolamine salts with molecular weights from about 800 to about 50,000.
7. Copolymers, of acrylic and maleic acid and the sodium, potassium, ammonium or mono-, di-, or triethanolamine salts with molecular weights greater than about 800.
8. Copolymers, of acrylic acid and itaconic acid and the sodium, potassium, ammonium or mono-, di-, or triethanolamine salts with molecular weights between about 800 and about 50,000.
9. Copolymers, of maleic acid and itaconic acid and the sodium, potassium, ammonium or mono-, di-, or triethanolamine salts with molecular weights between about 800 and about 50,000.
10. Amino trimethylene phosphonic acid and its sodium, potassium, ammonium or mono-, di-, or triethanolamine salts.
11. 1-hydroxyethylidine-1,1-diphosphonic acid and its sodium, potassium, ammonium or mono-, di-, or triethanolamine salts.
12. Hexamethylenediaminetetra(methylenephosphonic acid) and its sodium, potassium, ammonium or mono-, di-, or triethanolamine salts.
13. Diethylenetriaminepenta(methylene phosphonic acid) and its sodium, potassium, ammonium or mono-, di-, or triethanolamine salts.
14. Dequest 2041™ by Monsanto, which is a similar substituted phosphonic acid or salt.

Cationic, anionic, nonionic, and amphoteric surfactants may be included in the present invention in amounts between about 1% and 40%, between about 2% and 30%, between about 3% and 10% or any range subsumed therein. Suitable cationic surfactants include the family of quaternary ammonium chlorides and fatty amines converted to salts via neutralization using a suitable acid.

Suitable nonionic surfactants include:

1. Nonylphenol alkoxylates (e.g., ethoxylates, propoxylates), such as nonylphenol ethoxylates with between about 4 and about 150 ethylene oxide groups per nonylphenol molecule, i.e., nonylphenol $(\text{ethoxylate})_n$, n=4–150.
2. Dinonylphenol alkoxylates (e.g., ethoxylates, propoxylates), such as dinonylphenol ethoxylates with between about 4 and about 150 ethylene oxide groups per dinonylphenol molecule.
3. Alcohol alkoxylates (e.g., ethoxylates, propoxylates), as as linear alcohol ethoxylates with the alcohol chain consisting of between about 6 and 24 carbon atoms and with between about 2.5 and about 150 ethylene oxide groups per alcohol molecule.
4. Dodecylphenol ethoxylates with between about 4 and about 150 ethylene oxide groups per dodecylphenol molecule.
5. Octylphenol ethoxylates with between about 4 and about 150 ethylene oxide groups per octylphenol molecule.
6. Alkanolamides in which the carbon chain consists of a fatty acid (e.g., $C_{12}$–$C_{18}$) reacted with a mono- or diethanolamine or isopropanolamine to yield a product having a melting point above 100° F.
7. Ethoxylated alkanolamides in which the carbon chain consists of a fatty acid (e.g., $C_{12}$–$C_{18}$) reacted with ethylene oxide and mono- or diethanolamine or isopropanolamine.
8. Amine oxides having a carbon chain from about $C_8$ to about $C_{18}$.
9. Fatty acid alkoxylates, e.g., fatty acid ethoxylates with 2 or more ethylene oxide units per fatty acid (e.g., $C_8$–$C_{18}$).
10. alkyl alkoxylates (e.g., ethoxylates and propoxylates) having between about 2 and 150, e.g., 20 or more, alkoxide (ethylene or propylene oxide) units.

11. Ethylene oxide/propylene oxide block polymers.
12. Polyethylene glycol esters and diesters.
13. Sorbitan fatty acid esters.
14. Fatty amines.
15. Phosphate esters.
16. Glycerol monostrearates.
17. Glycerol distearates.

Suitable anionic surfactants for inclusion in the present invention include:

1. Alkyl sulfonate salts and alkylaryl sulfonate salts, supplied with sodium, potassium, ammonium, protonated mono-, di-, or triethanolamine or protonated isoproponolamine cations, such as the following salts:
   linear primary $C_6$–$C_{18}$ sulfonate salts;
   linear secondary $C_3$–$C_{18}$ sulfonate salts;
   alpha olefin sulfonate salts;
   dodecylbenzene sulfonate salts;
   tridecylbenzene sulfonate salts;
   xylene sulfonate salts;
   cumene sulfonate salts; and
   toluene sulfonate salts.
2. Alkyl sulfate salts and alkylaryl sulfate salts, supplied with either Na, K, NH4, protonated mono-, di-, or triethanolamine or protonated isopropanolamine cations, such as the following salts:
   linear primary $C_6$–$C_{18}$ sulfate salts;
   linear secondary $C_3$–$C_{18}$ sulfate salts; and
   $C_{12}$–$C_{13}$ benzene sulfate salts.
3. Alkyl $C_6$–$C_{18}$ naphthalene sulfonate salts with Na, K or $NH_4$ cations.
4. Alkyl $C_6$–$C_{18}$ diphenyl oxide sulfonates salts with Na, K or $NH_4$ cations, e.g., Dowfax 2A1® and Dowfax 3B2® (Dow).
5. Sodium sec-alkylsulfonate, e.g., Hastapur SAS® (Clariant-GmbH).
6. Alkyl ether sulfate salts or alkylaryl ether sulfate salts supplied with Na, K, $NH_4$, protonated mono-, di-, or triethanolamine, or protonated isoproponolamine cations, such as the following salts:
   alkyl $C_8$–$C_{18}$ alcohol (ethoxylate)$_{1-6}$ sulfate salts; and
   alkyl $C_8$–$C_{12}$, phenoxy (ethoxylate)$_{1-12}$ sulfate salts.
7. Alkyl ether sulfonate salts or alkylaryl ether sulfonate salts supplied with Na, K, $NH_4$, protonated mono-, di-, or triethanolamine or protonated isoproponolamine cations, such as the following salts:
   alkyl $C_8$–$C_{18}$ alcohol (ethoxylate)$_{1-6}$ sulfonate salts; and
   alkyl $C_8$–$C_{12}$ phenoxy (ethoxylate)$_{1-12}$ sulfonate salts.
8. $C_4$–$C_{18}$ dialkyl sulfosuccinate salts supplied with Na, K, $NH_4$, protonated mono-, di-, or triethanolamine or protonated isoproponolamine cations, such as disodium dioctyl sulfosuccinate.
9. Other anionic surfactants such as mono- or dialkyl phosphate ester salts, isothionates or taurate salts.

A nonlimiting listing of suitable amphoteric surfactants includes:

1. N-coco-3-aminopropionic acid and acid salts.
2. N-tallow-3-iminodiproprionate salts.
3. N-lauryl-3-iminodiproprionate disodium salt.
4. N-carboxymethyl-N-cocalkyl-N-dimethylammonium hydroxide. N-carboxymethyl-N-dimethyl-N-(9-octadecenyl) ammonium hydroxide.
5. (1-carboxyheptadecyl) trimethylammonium hydroxide.
6. (1-carboxyundecyl) trimethylammonium hydroxide.
7. N-cocoamidoethyl-N-hydroxyethylglycine sodium salt.
8. N-hydroxyethyl-N-stearamidoglycine sodium salt.
9. N-hydroxyethyl-N-lauramido-.beta.-alanine sodium salt.
10. N-cocoamido-N-hydroxyethyl-β-alanine sodium salt, as well as mixed alicyclic amines, and their ethoxylated and sulfated sodium salts.
11. 2-alkyl-1-carboxymethyl-1-hyroxyethyl-2-imidazolinium hydroxide sodium salt or free acid, wherein the alkyl group may be nonyl, undecyl, or heptadecyl.
12. 1,1-bis(carboxymethyl)-2-undecyl-2-imidazolinium hydroxide disodium salt.
13. oleic acid-ethylenediamine condensate.
14. amine oxides.

Amphoteric surface active agents may contain both carboxyl and amino functionality in their structure. These surfactants may generally be prepared by the condensation of fatty primary amines and acrylic monomers. Available products include salts and free acids of both the N-fatty aminopropionates and the N-fatty iminodipropionates.

The present invention may also include one or more solubility modifying agents. These modifying agents may include the aforementioned surfactants, as well as other alcohols, ethers, glycols, and the like. These solubility modifying agents may be present in amounts between about 0.1% and 10% between about 2% and 5% or any range subsumed therein.

Manufacture

To prepare the solid cast of the present invention, the waxy substance, or mixture of waxy substances, is placed in a suitable mixing vessel to which heat may be applied. Some of the waxy substance may be added as liquids and others as solids. The waxy substance(s) is then heated to between about 80° F. and 180° F., between about 100° F. and 160° F., between about 100° F. and 140° F. or any range subsumed therein. Within the desired temperature range, all of the waxy substances will melt to assume a generally fluid form. After the waxy substance(s) are melted, the heat may be discontinued, the mixer in the mixing vessel started, and the active chlorine source and optional additional substances (detergent builders, water conditioning agents, surfactants, and solubility modifying agents) may then be added at this point. The product may then be packaged as soon as the resulting mixture appears to be substantially homogenous. Many of the additional substances do not dissolve or melt, but remain as discrete particles to be suspended essentially uniformly in the increasingly viscous, cooling fluid. As the mixture cools, the viscosity thereof increases, thereby aiding to maintain the suspension of the granular particles. The mixture may often be allowed to cool to below about 120° F., while keeping the texture of the mixture somewhat viscous, but fluid enough to flow during product packaging. Continuous mixing may be employed to keep all ingredients suspended and homogeneously dispersed for uniform packaging. After being allowed to cool to the desired viscosity, the mixture may be is packaged by being poured into containers, such as plastic jars or bottles, where it is allowed to further cool and solidify.

An alternative method of manufacturing the present invention includes adding desired amounts of the active chlorine source, waxy substance, as well as any desired detergent builders, water conditioning agents, surfactants, and solubility modifying agents. The temperature is such that the waxy substance, or at least a portion thereof, must be solid, or substantially solid, when mixed and solidified into the present invention. In this case, the materials are thoroughly mixed until they are dispersed substantially homogeneously and are then dispensed into containers, where they are allowed to further solidify. Suitable mixers include ribbon or paddle mixers which generate flowable, semi-liquid substances during mixing.

In either manufacturing protocol the free moisture content of the present solid cast chlorinated composition should be less than about 5 percent by weight, e.g., between about 0.01% and 5.0%, or any range subsumed therein to ensure that chlorine gas is not liberated by reactions described hereinabove.

Product Usage

One method of use of the present invention is to dissolve a portion thereof in water by an appropriate and convenient means, to form a solution and/or dispersion for cleaning and whitening. The solution and/or dispersion formed may be directly used or may be further diluted before use.

One method of utilizing this invention employs the present composition solidified in plastic jars with approximate volumes of 1 to 5 quarts and having openings of between about 25 and 200 mm. Larger containers, such as up to 55 gallon open-head drums, may also be used. One method includes a dosage sufficient to form a wash/bleaching liquor with a solids (active chlorine) content of between about 0.001% and 5%, by weight, between about 0.01% and 5%, by weight, or any range subsumed therein, of the wash liquor. The pH of the wash/bleaching liquor may be between about 7–12, 8–11, 8.5–10.5, or any range subsumed therein at these concentrations. The wash/bleaching liquor may also express these pH ranges at concentrations greater than about 10 ppm, 50 ppm, 100 ppm, 150 ppm or up to 500 ppm of active chlorine (or any range subsumed therein).

When the detergent is used from a container, the container may be inverted into a bowl especially designed to receive the container. The bowl is disposed within an apparatus to dispense the dissolved product. Water is sprayed upwardly into the inverted container to dissolve a portion of the present solid product. One example of a suitable dispenser is disclosed in U.S. Pat. No. 5,342,587 to Laughlin et al., entitled Detergent Dispenser For Use With Solid Cast Detergent, hereby incorporated by reference.

An exemplary apparatus for forming and dispensing a solution and/or dispersion of this invention is designated generally at 100 in FIG. 1. The container 102, containing a substantially solid cast of the present invention, is inverted into a bowl 104. Water is sprayed from a tip 106 impinging the present substantially solid cast and dissolving a portion thereof. The dissolved portion may contain suspended ingredients. The dissolved portion runs down the bowl 104 into tube 108, where it may be further diluted or delivered directly to the appropriate location for use. A screen (not shown) may be present between the sprayer and detergent. However, under certain circumstances the screen may reduce the effectiveness of the spray to dissolve or disperse the present invention. The generated solution may run out through a tube in the bottom of the bowl by the force of gravity and/or suction. From the bowl, the solution flows through the tube either directly to a laundry machine, or, e.g., to a collecting box where it is further diluted with water, then carried or flushed into a laundry machine or other receptacle.

In another method of use, the present invention is formed into solid casts by being poured into molds, blocks or tablets rather than being solidified within containers such as jars. The solidified casts are usually separated from the molds before being transported to a site for use. These casts may weigh between about 1 oz. and 5 lbs. One or more of these casts are placed in a dispenser tub, wherein water flows over the casts, dissolving a portion of the casts to form a detergent solution and/or dispersion. The detergent solution may be transferred directly to a use application or further diluted as described hereinabove.

EXAMPLES

The following are non-limiting examples of specific ingredients and proportions of the present, substantially solid cast chlorinated compositions:

| | | | |
|---|---|---|---|
| 1. | Hexadecyl alcohol | 25.0% | |
| | Sodium dichloroisocyanurate* (60.0% active ingredient) *(hereafter CDB-60) | 75.0% | |
| 2. | Hexadecyl alcohol | 25.0% | |
| | Sodium dichloroisocyanurate* (56.0% active ingredient) *(hereafter CDB-56) | 75.0% | |
| 3. | Hexadecyl alcohol | 24.0% | |
| | CDB-60 | 40.0% | |
| | Sodium tripolyphosphate | 26.0% | |
| | Sodium hydroxide | 10.0% | |
| 4. | Hexadecyl alcohol | 20.0% | |
| | Tetradecyl alcohol | 4.0% | |
| | CDB-60 | 40.0% | |
| | Sodium tripolyphosphate | 10.0% | |
| | Dowfax 3B2 ®* | 5.0% | (Dow Chemical Co.) |
| | Sodium metasilicate | 21.0% | |
| | *Disodium salt of decyl(sulfophenoxy) benzenesulfonic acid | | |
| 5. | Paraffin | 60.0% | |
| | CDB-56 | 40.0% | |
| 6. | Hexadecyl alcohol | 15% | |
| | Paraffin | 10% | |
| | CDB-60 | 75% | |
| 7. | Hexadecyl alcohol | 20% | |
| | Paraffin | 4% | |
| | CDB-60 | 40% | |
| | Sodium tripolyphosphate | 26% | |
| | Sodium hydroxide | | |
| 8. | Hexadecyl alcohol | 16% | |
| | Tetradecyl alcohol | 4% | |
| | Paraffin | 4% | |
| | CDB-60 | 40% | |
| | Sodium tripolyphosphate | 10% | |
| | Dowfax 3B2 ® | 5% | |
| | Sodium metasilicate | 21% | |
| 9. | Hexadecyl alcohol | 27% | |
| | Dodecyl/tetradecyl alcohol | 6.0% | |
| | CDB-60 | 40% | |
| | Trisodium phosphate | 11% | |
| | Sodium tripolyphosphate | 10% | |
| | Potassium hydroxide | 1% | |
| | Dowfax 3B2 ® | 5% | |
| 10. | Hexadecyl alcohol | 20% | |
| | Paraffin | 5% | |
| | CDB-56 | 75% | |
| 11. | Hexadecyl alcohol | 35% | |
| | CDB-60 | 40% | |
| | Trisodium phosphate | 10% | |
| | Sodium tripolyphosphate | 10% | |
| | Linear alcohol ethoxylate | 5% | |

Because numerous modifications of this invention may be made without departing from the spirit thereof, the scope of the invention is not to be limited to the embodiments illustrated and described but to the appended claims and equivalents thereof.

What is claimed is:

1. A substantially homogeneous solid cast composition, comprising:

a waxy substance selected from paraffins, fatty alcohols, and mixtures thereof; and an active chlorine source.

2. The solid cast composition of claim 1, further comprising a detergent builder.

3. The solid cast composition of claim 2, the detergent builder comprising an alkali metal hydroxide.

4. The solid cast composition of claim 1, further comprising a hardness metal sequestering agent.

5. The solid cast composition of claim 1, further comprising a solubility modifying agent.

6. The solid cast composition of claim 1, in which the waxy substance comprises a fatty alcohol.

7. The solid cast composition of claim 1, in which the waxy substance comprises a $C_{12}$–$C_{24}$ linear fatty alcohol.

8. The solid cast composition of claim 1, in which the waxy substance is present in an amount between about 10 weight percent and 99 weight percent.

9. The solid cast composition of claim 1, in which the waxy substance is present in an amount between about 15 weight percent and 70 weight percent.

10. The solid cast composition of claim 1, in which the waxy substance is present in an amount between about 25 weight percent and 50 weight percent.

11. The solid cast composition of claim 1, in which the waxy substance has a melting point between about 80 degrees F. and 180 degrees F.

12. The solid cast composition of claim 1, in which the waxy substance has a melting point between about 100 degrees F. and 160 degrees F.

13. The solid cast composition of claim 1, in which the waxy substance has a melting point between about 100 degrees F. and 140 degrees F.

14. The solid cast composition of claim 1, further comprising a surfactant selected from anionic surfactants, cationic surfactants, nonionic surfactants, amphoteric surfactants, and mixtures thereof.

15. The solid cast composition of claim 1, further comprising a detergent builder, the detergent builder forming an aqueous solution with a pH greater than about 7.0 at a concentration greater than about 100 ppm.

16. The solid cast composition of claim 1, in which the solid cast composition will not pass through a 1.27 centimeter square sieve.

17. The solid cast composition of claim 1, in combination with a container, the solid cast detergent solidified and contained within the container.

18. The solid cast composition and container of claim 1, in combination with a dispenser, the dispenser with a spray tip, the container invertably disposed within the dispenser such that a spray from the dispenser spray tip impinges the solid cast composition, the solid cast composition forming a use solution when a portion thereof is dissolved by the spray from the dispenser spray tip.

19. The solid cast composition of claim 1, in which the active chlorine source comprises between about 3 weight percent and 90 weight percent available chlorine.

20. The solid cast Composition of claim 1, in which the active chlorine source comprises between about 50 weight percent and 70 weight percent available chlorine.

21. The solid cast composition of claim 1, in which the active chlorine source comprises between about 0.2 weight percent and 60 weight percent available chlorine.

22. The solid cast composition of claim 1, in which the active chlorine source comprises between about 1.0 weight percent and 50 weight percent available chlorine.

23. The solid cast composition of claim 1, in which the active chlorine source comprises an alkali metal dichloro (iso)cyanurate.

24. A substantially homogeneous solid cast composition, comprising:

a waxy substance selected from paraffins, fatty alcohols, and mixtures thereof;

an active chlorine source; and a detergent builder, wherein said composition is prepared by:

heating the waxy substance to above its melting point, adding the active chlorine source to the heated waxy substance to form a first mixture of the melted waxy substance and the active chlorine source, maintaining the mixture not more than about 80 degrees F. above the melting point of the waxy substance, while adding the detergent builder to form a second mixture, and casting the second mixture to obtain the solid cast composition.

25. The solid cast composition of claim 24, wherein the composition is further prepared by agitating the second mixture such that the detergent builder is suspended substantially homogeneously.

26. The solid cast composition of claim 24, further comprising a surfactant selected from anionic surfactants, cationic surfactants, nonionic surfactants, amphoteric surfactants, and mixtures thereof, wherein said composition is further prepared by adding said surfactant prior to casting said second mixture.

27. A method of forming a substantially homogeneous solid cast detergent composition, comprising:

melting a waxy substance selected from paraffins, fatty alcohols, and mixtures thereof;

adding an active chlorine source to the melted waxy substance; and casting the melted waxy substance and active chlorine source in a container.

28. The method of claim 27, in which the waxy substance is melted at a temperature between about 80 degrees F. and 180 degrees F.

29. The method of claim 27, in which the waxy substance is melted at a temperature between about 100 degrees F. and 160 degrees F.

30. The method of claim 27, and which the waxy substance is melted at a temperature between about 100 degrees F. and 140 degrees F.

31. The method of claim 27, further comprising adding a detergent builder.

32. The method of claim 27, further comprising adding a surfactant selected from an anionic surfactant, a cationic surfactant, a nonionic surfactant, an amphoteric surfactant, and any mixture thereof.

33. A method of treating a fabric, comprising:

forming an aqueous use solution by dissolving a portion of the composition of claim 1 in a quantity of water; and immersing the fabric in the use solution.

34. The method of claim 33, in which the solid cast composition is solidified in a container, the container is invertably disposed in a dispenser, the dispenser with a spray tip configured such that a spray from the dispenser spray tip impinges the solid cast composition, and in which the aqueous use solution is formed by impinging the spray on the solid cast composition, thereby dissolving a portion of the solid cast composition.

35. The method of claim 34, in which the dispenser comprises a bowl, and in which the aqueous use solution is formed while the container is invertably disposed in the bowl.

36. The method of claim 35, in which the dispenser further comprises a tube and in which the aqueous use solution formed by dissolving a portion of the solid cast composition runs down the bowl and through the tube before the fabric is immersed in the use solution.

37. The method of claim 36, in which the use solution is diluted before the fabric is immersed therein.

38. The method of claim 33, in which the fabric is immersed in a use solution with an active chlorine concentration between about 10 ppm and 500 ppm.

39. The method of claim 33, in which the fabric is immersed in a use solution with an active chlorine concentration between about 50 and 150 ppm.

40. The method of claim 33, in which the fabric is immersed in a use solution with a pH between about 7.0 and 12.0.

41. The method of claim 33, in which the fabric is immersed in a use solution with a pH between about 8.0 and 11.0.

42. The method of claim 33, in which the fabric is immersed in a use solution with a pH between about 8.5 and 10.5.

43. A method of cleaning a surface, comprising:

forming an aqueous use solution by dissolving a portion of the composition of claim 1; and contacting the surface with the use solution.

44. The method of claim 43, further comprising rinsing the use solution from the surface.

* * * * *

UNITED STATES PATENT AND TRADEMARK OFFICE

CERTIFICATE OF CORRECTION

PATENT NO. : 6,475,969 B2
DATED : November 5, 2002
INVENTOR(S) : William H. Scepanski It is certified that error appears in the above-identified patent and that said Letters Patent is hereby corrected as shown below:

Column 2,
Line 61, please delete the word "intention" and insert in its place -- invention. --

Column 6,
Line 41, please delete the second occurrence of "as."
Line 65, please delete "alkyl" and insert -- Alkyl. --

Column 8,
Line 62, please after "may be" please delete the word "is."

Signed and Sealed this

Fifteenth Day of March, 2005

JON W. DUDAS
*Director of the United States Patent and Trademark Office*